United States Patent [19]

Mai et al.

[11] Patent Number: 4,510,048

[45] Date of Patent: Apr. 9, 1985

[54] PROCESS FOR IMPROVING PROBERTITE CONCENTRATION IN PROBERTITE CONTAINING ORE

[75] Inventors: Anh Mai, Grand Rapids; Donald J. Kaczynski, Pengilly, both of Minn.; Lawrence W. Trainor, deceased, late of Portales, N. Mex., by Marie L. Trainor, executrix

[73] Assignee: Owens-Corning Fiberglas Corporation, Toledo, Ohio

[21] Appl. No.: 535,513

[22] Filed: Sep. 26, 1983

[51] Int. Cl.[3] ..... B03B 1/00

[52] U.S. Cl. ..... 209/3; 209/166; 241/24

[58] Field of Search ..... 209/166, 167; 75/1 R; 241/24

[56] References Cited

U.S. PATENT DOCUMENTS

| | | | |
|---|---|---|---|
| 2,317,413 | 4/1943 | Shelton | 209/166 |
| 3,635,338 | 1/1972 | Chemtob et al. | 209/166 |
| 3,768,738 | 10/1973 | Sawyer et al. | 209/166 |
| 4,233,051 | 11/1980 | Eastes . | |
| 4,441,993 | 4/1984 | Howald | 209/167 |

FOREIGN PATENT DOCUMENTS

| | | | |
|---|---|---|---|
| 122128 | 8/1946 | Australia | 209/166 |

OTHER PUBLICATIONS

Aero 845-Promotor Am. Cyanamid, Am. Cyanamid Co., Wayne, N.J., 5/79.

*Primary Examiner*—Bernard Nozick

*Attorney, Agent, or Firm*—Ronald C. Hudgens; Patrick P. Pacella; Philip R. Cloutier

[57] ABSTRACT

A process for recovering a probertite concentrate from ore in which the major borate mineral is probertite which comprises crushing the ore, desliming at 14 to 20 microns and floating the deslimed ore to recover the concentrate.

7 Claims, 1 Drawing Figure

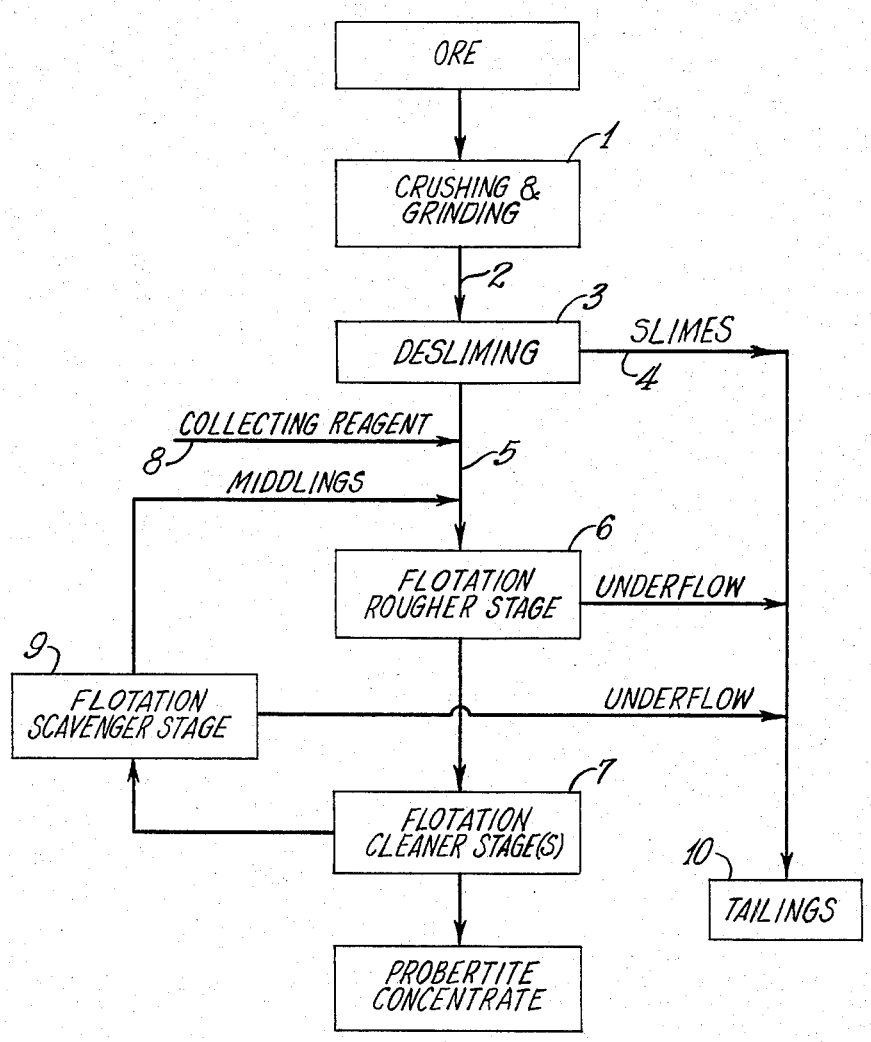
ORE
CRUSHING & GRINDING
1
2
DESLIMING
3
SLIMES
4
COLLECTING REAGENT
8
5
MIDDLINGS
FLOTATION ROUGHER STAGE
6
UNDERFLOW
9
FLOTATION SCAVENGER STAGE
UNDERFLOW
FLOTATION CLEANER STAGE(S)
7
10
TAILINGS
PROBERTITE CONCENTRATE

PROCESS FOR IMPROVING PROBERTITE CONCENTRATION IN PROBERTITE CONTAINING ORE

TECHNICAL FIELD

This invention relates to a process for improving the probertite concentration in probertite-containing ore.

In one of its more specific aspects, this invention relates to a process of treating a borate crude ore containing from about 30 to about 40 weight percent probertite, to produce a concentrate containing from about 60 to about 80 weight percent probertite.

The existence of crude ores containing borates is well known. One such crude ore contains from about 15 to about 20 weight percent $B_2O_3$ in form of probertite and traces of other borate minerals such as colemanite, ulexite, howlite and gangue components comprising quartz, calcite, clay and the like. While the probertite concentration in such ores is considerable, such ores have previously been considered of marginal value because no practical method of recovering, or enhancing, the probertite values thereof has been available. This invention provides a method of doing so.

STATEMENT OF INVENTION

According to this invention, there is provided a method of recovering the probertite from ores in which the major borate mineral is probertite which comprises crushing and grinding the ore, preferably to a particle size of about 35 mesh, maximum, desliming the ground ore at approximately 14 microns, but preferably at 20 microns, to produce a deslimed product, conditioning the deslimed product and subjecting the conditioned, deslimed product to at least one flotation stage to produce a probertite concentrate.

BRIEF DESCRIPTION OF THE DRAWING

The attached drawing is a schematic flow diagram of the process.

DETAILED DESCRIPTION

The method of this invention is applicable to any probertite-containing ore. It is particularly applicable to crude ores of which the major borate mineral is probertite contained in the ore in an amount from about 30 to about 40 weight percent.

Referring to the attached drawing, the crude ore is subjected to a size reduction step 1 to reduce the ore to about 35 mesh, maximum. Any suitable size reduction process can be employed. Preferably, a plurality of steps will be employed, the first being impact crushing and the second being wet ball milling, the combination being sufficient to attain the desired particle size.

The ground crude ore 2, is then introduced into a conventional desliming process 3. Any suitable desliming process, including hydrocycloning or elutriation can be employed. The desliming is conducted at from about 14 to about 20 microns or less, preferably at about 20 microns, to produce a slime product comprising clays, fine calcite, fine borates and the like and a deslimed product 5.

The deslimed product is then subjected to one or more flotation stages and preferably to a rougher stage flotation 6, a cleaner stage flotation 7 and a scavenger stage flotation g.

Any suitable number and type of flotation stages can be used. The flotation stages will preferably be conducted in the presence of conventional collecting reagents, at the natural pH, such reagents usually being anionic petroleum sulfonates.

Such agents as can be employed include a combination of American Cyanamid's Aero Promoters 845 and 825 in a 1 to 1 weight ratio.

Also employable is a combination of American Cyanamid's Aero Promoters 801 and 825 in a 1 to 3 weight ratio.

Either of these combinations is employed in an amount of about 2.5 pounds of the reagent mixture, in a 10 weight percent solution, per ton of crude ore, the reagent solution 8 being introduced directly into the deslimed slurry prior to the flotation rougher stage.

The product from the final flotation cleaner stage is recovered as the probertite concentrate which can be filtered and dried employing conventional procedures. This concentrate will amount from about 30 to about 40 weight percent of the original crude ore and will contain from about 70 to about 80 weight percent probertite.

The underflow from the flotation rougher and scavenger stage, and the slime product from the desliming process can be combined as the tailings 10. Also some portion of the middlings from the flotation scavenger stage can be recycled and combined with the deslimed product charged to the flotation rougher stage.

EXAMPLES

The following examples demonstrates the results or carrying out this invention according to the method previously described.

EXAMPLE I

A closed circuit flotation process was carried out as described above. One rougher flotation step was employed from which a rougher tails product was produced.

Four cleaner flotation steps were carried out, the combined underflow therefrom being routed to a scavenger flotation step g to produce scavenger tails and an overflow product which was recycled and combined with the deslimed product to the rougher flotation step.

The collecting agent employed was a combination of American Cyanamid's Aero Promoters 825 and 845 in a 1 to 1 weight ratio, the combination being employed in an amount of 2.3 pounds per ton of crude ore. Results were as follows when desliming at 20 microns:

| Product | % Wt. | % $B_2O_3$ | % Na | % $B_2O_3$ Dist | % Na Dist |
|---|---|---|---|---|---|
| Concentrate | 35.10 | 37.2 | 3.62 | 68.27 | 62.77 |
| Scav. Tails | 9.53 | 8.3 | 1.07 | 4.14 | 5.04 |
| Rougher Tails | 17.40 | 4.8 | 0.69 | 4.37 | 5.93 |
| Slimes | 37.97 | 11.7 | 1.40 | 23.22 | 26.26 |
| Total | 100.00 | (19.13) | (2.02) | 100.00 | 100.00 |

These data demonstrate the efficiency of the process in concentrating the $B_2O_3$ values in the probertite concentrate.

EXAMPLE II

A second run was made in the manner of Example I except that the collecting agent employed was a combination of American Cyanamid's Aero Promoters 801 and 825 in a 1 to 3 weight ratio, the combination being employed in an amount of 2.5 pounds per ton of crude ore. Results were as follows when desliming at 20 microns:

| Product | % Wt. | % $B_2O_3$ | % Na | % $B_2O_3$ Dist. | % NA Dist. |
|---|---|---|---|---|---|
| Concentrate | 34.69 | 36.6 | 3.40 | 65.56 | 57.45 |
| Scav. Tails | 8.69 | 8.8 | 1.28 | 3.95 | 5.42 |
| Rougher Tails | 19.95 | 6.8 | 0.99 | 7.01 | 9.62 |
| Slimes | 36.67 | 12.4 | 1.54 | 23.48 | 27.51 |
| Total | 100.00 | (19.36) | (2.05) | 100.00 | 100.00 |

These data similarly demonstrate beneficiation of the ore.

The removal of the −20 micron slime fraction, which consists mainly of clays and fine calcite, contributes significantly to the success of the method of the present convention. This is shown by the following data:

EXAMPLE III

A series of tests were run in which all conditions were substantially identical except as concerns the nominal particle size of the slime removed. Results were as follows:

| Test No. | Nominal Particle Size of Slime Removed | Flotation Results: Conc. Grade (% $B_2O_3$) | Flotation Results: Boron Recovery (% $B_2O_3$ Units) |
|---|---|---|---|
| 38 | 0 (no desliming) | No separation | |
| 3 | 10 microns | No separation | |
| 47 | 14 microns | 36.89 | 46.80 |
| 48 | 17 microns | 37.99 | 49.73 |
| 62 | 20 microns | 37.13 | 62.91 |

These data demonstrate that the recovery of probertite, when carried out when desliming in the size range of 14 to 20 microns yields an improved boron recovery with 20 microns being the preferred range.

It will be evident from the foregoing that various modifications can be made to the method of this invention. Such, however, are considered within the scope of the invention.

We claim:

1. A process for recovering a probertite concentrate from borate ore in which the major borate mineral is probertite which comprises:

(a) crushing the ore;

(b) desliming the crushed ore at from about 14 to about 20 microns to produce a deslimed product;

(c) floating the deslimed product and a collecting agent into a flotation stage and separating a probertite concentrate as an overflow stream wherein said collecting agent is an anionic petroleum sulfonate or a mixture of anionic petroleum sulfonates; and, (d) recovering the probertite concentrate.

2. The process of claim 1 in which said desliming is conducted at 20 microns.

3. The process of claim 1 in which said flotation stage comprises at least one rougher stage and one cleaner stage.

4. The process of claim 3 in which middlings from the flotation scavenger stage are recycled to the flotation rougher stage.

5. The process of claim 1 in which the amount of the probertite in the concentrate is from about 70 to about 80 weight percent.

6. The process of claim 5 in which the amount of the concentrate recovered is from about 30 to about 40 weight percent of the ore.

7. The process of claim 5 in which the amount of the $B_2O_3$ units in the concentrate is from about 65 to about 68 percent of the total $B_2O_3$ units in the ore.

* * * * *